US005498828A

United States Patent [19]

Matsuda et al.

[11] Patent Number: 5,498,828

[45] Date of Patent: Mar. 12, 1996

[54] SOLIDIFICATION AGENTS FOR RADIOACTIVE WASTE AND A METHOD FOR PROCESSING RADIOACTIVE WASTE

[75] Inventors: Masami Matsuda; Takashi Nishi; Makoto Kikuchi, all of Hitachi; Tatsuo Izumida, Katsuta; Shin Tamata, Ooarai; Yoshimasa Kiuchi, Katsuta, all of Japan

[73] Assignees: Hitachi, Ltd., Tokyo; Hitachi Engineering & Services Co., Ltd., Ibaraki, both of Japan

[21] Appl. No.: 34,885

[22] Filed: Mar. 19, 1993

[30] Foreign Application Priority Data

Mar. 19, 1992 [JP] Japan ..... 4-063141

[51] Int. Cl.[6] ..... A62D 3/00; G21F 9/00

[52] U.S. Cl. ..... 588/252; 588/3

[58] Field of Search ..... 588/249, 252, 588/255, 256, 257, 2–4; 405/128, 129

[56] References Cited

U.S. PATENT DOCUMENTS

| | | | |
|---|---|---|---|
| 4,139,488 | 2/1979 | Knotik et al. | 588/252 |
| 4,209,335 | 6/1980 | Katayama et al. | 588/252 |
| 4,234,632 | 11/1980 | Lubowitz | 588/255 X |
| 4,461,722 | 7/1984 | Knieper et al. | 588/252 |
| 4,518,508 | 5/1985 | Conner | 588/3 X |
| 5,196,620 | 3/1993 | Gustin et al. | 588/257 |
| 5,269,975 | 12/1993 | Noakes | 588/252 X |

FOREIGN PATENT DOCUMENTS

| | | | |
|---|---|---|---|
| 53-113763 | 10/1978 | Japan | 588/255 |
| 63-289500 | 11/1988 | Japan . | |
| 3-105298 | 5/1991 | Japan . | |

*Primary Examiner*—George A. Suchfield
*Attorney, Agent, or Firm*—Antonelli, Terry, Stout & Kraus

[57] ABSTRACT

An object of the present invention is to improve retainability (distribution coefficient) for C-14 of a radioactive waste solidified body. The waste is solidified with a solidification agent containing a soluble substance which yields an insoluble substance by a reaction with carbonic ions, insoluble carbonates, or a mixture of the above substances. And, as for a pre-treatment, the soluble substance which yields an insoluble substance by a reaction with carbonic ions is previously reacted with liquid waste, and subsequently the solidification is performed. The retainability (distribution coefficient) for C-14 of the solidified body of the waste increases about one order.

23 Claims, 5 Drawing Sheets

SOLIDIFICATION AGENTS FOR RADIOACTIVE WASTE AND A METHOD FOR PROCESSING RADIOACTIVE WASTE

BACKGROUND OF THE INVENTION (1) Field of the Invention

The present invention relates to solidification agents for solidifying such radioactive waste as concentrated liquid waste and spent ion exchange resin (called spent resin hereinafter) etc. and a method for processing the radioactive waste, and, especially, to preferable solidification agents for improving retainability for radioactive nuclides, particularly C-14, in the radioactive waste, and a method for processing the radioactive waste.

(2) Description of the Prior Art

Low level radioactive wastes which are generated at radioactive material handling facilities such as nuclear power plants are safely solidified with ordinary portland cement or plastics as disclosed in JP-A-63-289500 (1988).

As for cementitious solidification agents, ordinary portland cement shares more than 30%, and the residual is shared with cements of which the main components are slag, and fly-ash, or cement-glass of which the main component is sodium silicates. By solidification of the radioactive waste with the above described solidification agents, such radioactive nuclides as Co-60, Sr-90, Cs-137, and C-14 in the waste can be retained in the solidified bodies in a sufficiently stable condition.

Additionally, for further improving retainability of a solidified body for the radioactive nuclides, addition of such an adsorbent for radioactive nuclides as zeolite etc. into a solidification agent such as cement is performed as disclosed in JP-A-3-105298 (1991). As the adsorbent has a property to adsorb cations, the retainability of the solidified body for Co-60, Sr-90, and Cs-137 etc. is remarkably improved. However, as C-14 is not a cation, the retainability of the solidified body for C-14 is not improved by the previously described prior art.

The amount of C-14 contained in so-called low level radioactive waste is very small, and accordingly, the low level radioactive waste can be solidified in a sufficiently stable condition even by the prior art. But, in consideration of a long half life of C-14 as about 5700 years, it is preferable to improve further the retainability of the solidified body for C-14.

SUMMARY OF THE INVENTION (1) Objects of the Invention

An object of the present invention is to provide a solidification agent which can improve retainability of a radioactive waste solidified body for C-14 and a method for processing the radioactive waste.

(2) Methods Solving the Problems

The above described object of the present invention can be realized by addition of a soluble substance which yields insoluble compounds by a reaction with carbonic ions into a solidification agent.

The above described object can also be realized by previously mixing liquid waste and a soluble substance which yields insoluble compounds by a reaction with carbonic ion as a pre-processing step, and, subsequently, solidifying the waste.

Furthermore, the above described object can be realized by using a solidification agent which is added with insoluble carbonates.

First, it is necessary to define a phrase "retainability of a solidified body for C-14". It is well known that, although a solidified body is stored in air at room temperature, such radioactive material as C-14 is not released into air. However, assuming a case of land depository, when the solidified body is immersed into water, there are some cases wherein a very small amount of radioactive material is gradually released into the water. As an index for evaluating retainability of a solidified body for radioactive nuclides when the solidified body is immersed into water, such as the above described cases, there is a distribution coefficient. That is, the pulverized solidified body is immersed into water and is agitated in the water until it reaches a steady state, and subsequently, the distribution coefficient is determined by the equation (1). It is common to understand that a large value of the distribution coefficient means a large retainability of the solidified body for C-14.

$$\text{Distribution coefficient} = \text{Concentration of C-14 in the solidified body} \div \text{Concentration of C-14 in water} \quad (1)$$

In the present invention, the retainability of the solidified body for C-14 is evaluated using the distribution coefficient defined by the equation (1).

As a first step for increasing a value of the distribution coefficient of the solidified body for C-14, the inventors examined chemical forms of C-14 contained in the radioactive waste. As a result, it was revealed that, in many cases, especially in most of the radioactive waste from nuclear power plants C-14 exists in a form of carbonic ion ($CO_3^{2-}$). Accordingly, it was thought that the carbonic ions must be fixed in the solidified body in order to increase the value of the distribution coefficient for C-14, and the present invention explained hereinafter was achieved.

That is, it is thought that the carbonic ion in an insoluble compound was preferable in order to prevent the solidified body from releasing C-14 into water even if the solidified body contacts with the water. As for insoluble compounds of carbonic ion, there are alkaline earth metal compounds (such as $CaCO_3$ etc.) and transition metal compounds (such as $FeCO_3$ etc.) and others. For example, subsequent to solidification of radioactive waste using a solidification agent containing soluble $CaCl_2$, when the solidified body contacts with water, carbonic ions containing C-14 will be released into water, but simultaneously, soluble $CaCl_2$ will be dissolved into water. Accordingly, a chemical reaction expressed by the equation (2) occurs in the water, and the carbonic ion precipitates in the solidified body as calcium carbonate.

$$CaCl_2 + CO_3^{2-} \rightarrow CaCO_3\downarrow + 2Cl^- \quad (2)$$

As a result, C-14 becomes substantially equivalent to be retained in the solidified body, and accordingly, the distribution coefficient defined by the equation (1) increases. Chemical reactions such as expressed by the equation (2) are not restricted to $CaCl_2$, but easily occur with soluble alkaline earth metal compounds ($Ca(NO_3)_2$, $SrCl_2$, $MgSO_4$, $BaCl_2$ etc.) and transition metal compounds ($FeCl_2$, $FeI_2$, $CoCl_2$, $Mn(NO_3)_2$ etc.).

As explained above, when the radioactive waste is solidified with the solidification agent containing soluble alkaline earth metal compounds or transition metal compounds, the distribution coefficient of the solidified body for C-14 increases remarkably. However, the following problems must be resolved for realization of the above described remarkable increment of the distribution coefficient.

That is, for example, in a case when cement is used for a solidification agent, even if soluble alkaline earth metal compounds such as $CaCl_2$ or transition metal compounds (hereinafter $CaCl_2$ is taken as an example for the following explanation) are previously added to the cement, kneading water which is added for hardening of the cement will dissolve the $CaCl_2$. Accordingly, almost all of the added $CaCl_2$ reacts with the cement and is consumed at the hardening stage of the cement. As the result, only a very small amount of soluble $CaCl_2$ remains in the solidified body, and a capacity for precipitating carbonic ions when the solidified body is immersed into water decreases remarkably. As a result of various investigation for resolving the above problem, it was revealed that a preferable result was obtained if the soluble alkaline earth metal compounds or transition metal compounds are added to the solidification agent after they were processed for granulation or water repellent treatment.

That is, if $CaCl_2$ is in a granular state having a small specific surface area, the $CaCl_2$ is scarcely consumed by a reaction with cement during solidification of the cement. And, if $CaCl_2$ is previously processed with a water repellent treatment, the $CaCl_2$ which is dissolved during solidification of the cement decreases remarkably. As the result, $CaCl_2$ exists in a solid body wherein solidifying reaction of cement has finished, and a distribution coefficient of the solid body for C-14 increases. In the above explanation, $CaCl_2$ was taken as an example. But, the operation explained above is common to all of the additive agents such as $Ca(NO_3)_2$, $SrCl_2$, $FeCl_2$ etc.

The above described example is a case wherein a substance which yields an insoluble compound by a reaction with a carbonic ion is contained in a solidification agent, but same advantages can be obtained by pre-treatment of the waste.

That is, all or a part of carbonic ions containing C-14 in liquid waste or waste which is immersed into water exist in water. When a soluble alkaline earth metal compound or a soluble transition metal compound is added to the above described liquid, a reaction expressed by the equation (2) or a similar reaction occurs and the carbonic ions are precipitated as an insoluble compound. If the waste is processed with a solidification process after the pre-treatment described above has been performed, a large distribution coefficient can be obtained because the carbonic ions have become insoluble, and the carbonic ions containing C-14 is not eluted from the solidified body into water when the solidified body is immersed in the water.

In addition to the above described examples, the distribution coefficient for C-14 can be increased by other methods such as solidification of waste with a solidification agent containing organic silane compounds and solidification of waste after pre-treatment of liquid waste or waste which is immersed in water with organic silane compounds. In this case, it was assumed that the organic silane compound reacted with carbonic ion and yielded an insoluble compound.

The above described examples are cases wherein carbonic ions are fixed in a solidified body in a form of insoluble compound, but additionally, a method utilizing an isotopic exchange is also effective.

For instance, if an insoluble carbonate compound (such as $CaCO_3$ etc.) is kept mixed with a solidification agent, carbonic ions containing C-14 and non-radioactive $CaCO_3$ cause an isotopic exchange, and C-14 moves into the insoluble carbonate compound. Consequently, C-14 is facilitated to be retained in a solidified body, and the distribution coefficient increases. As for the insoluble carbonate compounds, carbonates of alkaline earth metal and of transition metal can be utilized. Concretely, $MgCO_3$, $CaCO_3$, $SrCO_3$, $BaCO_3$, $FeCO_3$, $CoCO_3$, $MnCO_3$, and $NiCO_3$ etc. are effective.

DETAILED DESCRIPTION OF THE EMBODIMENTS

EMBODIMENT 1

Figure 1:
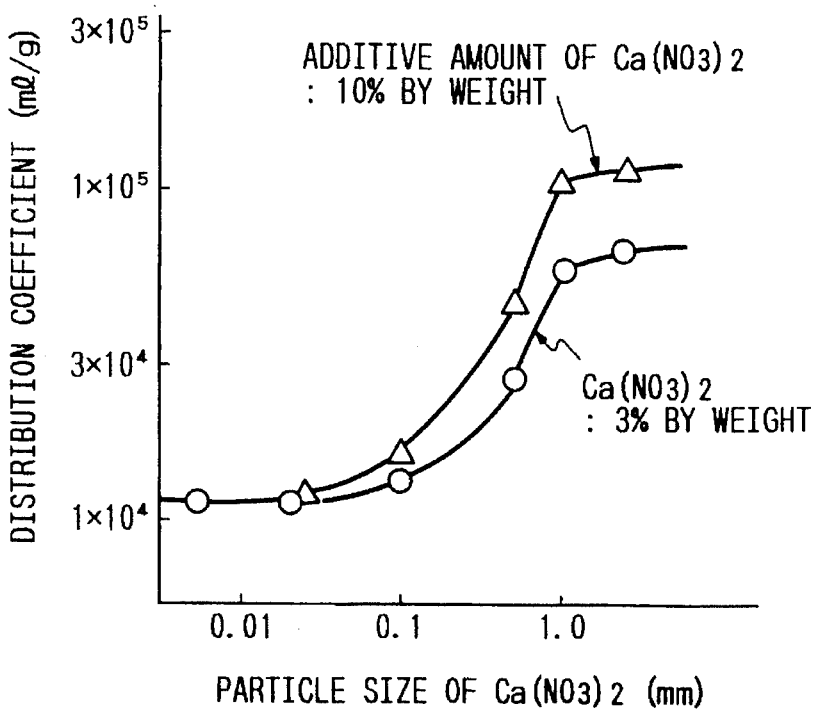
FIG. 1 is a graph indicating an effect of an adsorbent made from calcium nitrate which is used in an embodiment of the present invention.

The present embodiment relates to a solidification process for pellets made from incineration ashes with a cementitious solidification agent. As for the cementitious solidification agent (inorganic hydraulic solidification agent), there are portland cement, slag cement, fly-ash cement, alumina cement, and cement-glass etc. However, the same result is obtained by using any of the above solidification agents, and accordingly, a case using alumina cement is explained in the present embodiment.

As for simulated waste, ordinary industrial waste of which the main components were combustible items such as paper etc. were incinerated, and subsequently, an aqueous solution of sodium carbonate which contains 1 mCi of C-14 was homogeneously dispersed into 1 kg of the incineration ashes. The incineration ashes were fabricated in a shape of a pellet 1 cm in diameter, and were filled into a vessel having a capacity of 1 liter. Subsequently, a paste of solidification agent of which the main component was alumina cement having water/solidification agent ratio of 0.3 was prepared and poured into the vessel. As the result, spaces among pellets were filled almost completely with the paste of the solidification agent, and a solidified body of the simulated waste was obtained after one month curing. A distribution coefficient for C-14 was determined by the steps of pulverizing the solidified body of the simulated waste, immersing 10 grams of the powder of the simulated waste into 100 ml of water, and calculating the distribution coefficient by the equation (1).

The number of kinds of the prepared solidified bodies were more than twenty, and the solidification agents used were mutually different.

A few example of the solidification agents used in the present embodiment are shown hereinafter.

(1) Only alumina cement (2) Alumina cement 97% by weight+ $Ca(NO_3)_2$ having an average particle size of 0.1 mm 3 % by weight (3)(2) Alumina cement 97% by weight+$Ca(NO_3)_2$ having an average particle size of 0.5 mm 3 % by weight (4) Alumina cement 97% by weight+$Ca(NO_3)_2$ having an average particle size of 2 mm 3% by weight (5) Alumina cement 90% by weight+$Ca(NO_3)_2$ having an average particle size of 2 mm 10% by weight (6) Alumina cement 97% by weight+$Ca(NO_3)_2$ having an average particle size of 0.1 mm 3% by weight which was previously processed for water repellent treatment Among the above examples, the examples (2)–(4) were for determining effects of particle size of $Ca(NO_3)_2$ (calcium nitrate) which were added as an adsorbent for C-14 on the distribution coefficient, (4) and (5) were for determining effects of additive amount of $Ca(NO_3)_2$ on the distribution coefficient, and (2) and (6) were for determining effects of water repellent treatment of $Ca(NO_3)_2$ on the distribution coefficient.

As for an example of the experimental result, effects of particle sizes and additive amount of the adsorbent on the distribution coefficient are shown in FIG. 1. FIG. 1 reveals that effects of the adsorbent ($Ca(NO_3)_2$) depend on the particle size and the additive amount. It is revealed that the distribution coefficient increases with increasing of the additive amount, and retainability of the solidified body for C-14 is improved more than one order (the distribution coefficient of a solidified body which uses alumina cement without any adsorbent as a solidification agent is $1\times10^4$ ml/g). Regarding the particle size, it is found that performance as an adsorbent becomes remarkable when the particle size is at least 0.1 mm, preferably, more than 1 mm.

The reasons for the above observation can be assumed as followings.

That is, even if $Ca(NO_3)_2$ in fine powder state is previously added to the cement, the $Ca(NO_3)_2$ is dissolved into water when kneading water is added for solidification of the cement. Consequently, in the course of the cement solidification, most of the $Ca(NO_3)_2$ is consumed by a reaction with the cement, and the amount of the soluble $Ca(NO_3)_2$ which remains in the solidified body becomes very small and performance as an adsorbent decreases remarkably. However, if the particle size of the adsorbent is as large as granules, the adsorbent is scarcely dissolved because of its small specific surface area and the $Ca(NO_3)_2$ is scarcely consumed by the reaction with the cement. In accordance with the above described reason, the performance of the adsorbent is assumed to depend on the particle size.

If the above assumption is correct, performance of the adsorbent is assumed to be retained by processing the adsorbent in order to prevent the adsorbent from dissolving into water with a solidification reaction of the cement even if the adsorbent in fine powder state is used. Therefore, $Ca(NO_3)_2$ in fine powder state was processed for water repellent treatment. Concretely, $Ca(NO_3)_2$ powder having an average particle size of 0.1 mm was once immersed into a stylene-butadiene polymer emulsion, and subsequently dried for elimination of water. Using a solidification agent consisting of the above treated $Ca(NO_3)_2$ powder, 3% by weight, and alumina cement, 97% by weight, the distribution coefficient was determined again. As the result, the value of the distribution coefficient was $2\times10^5$ ml/g and improved to almost 20 times the value in a case using a solidification agent without adsorbent.

Figure 2:
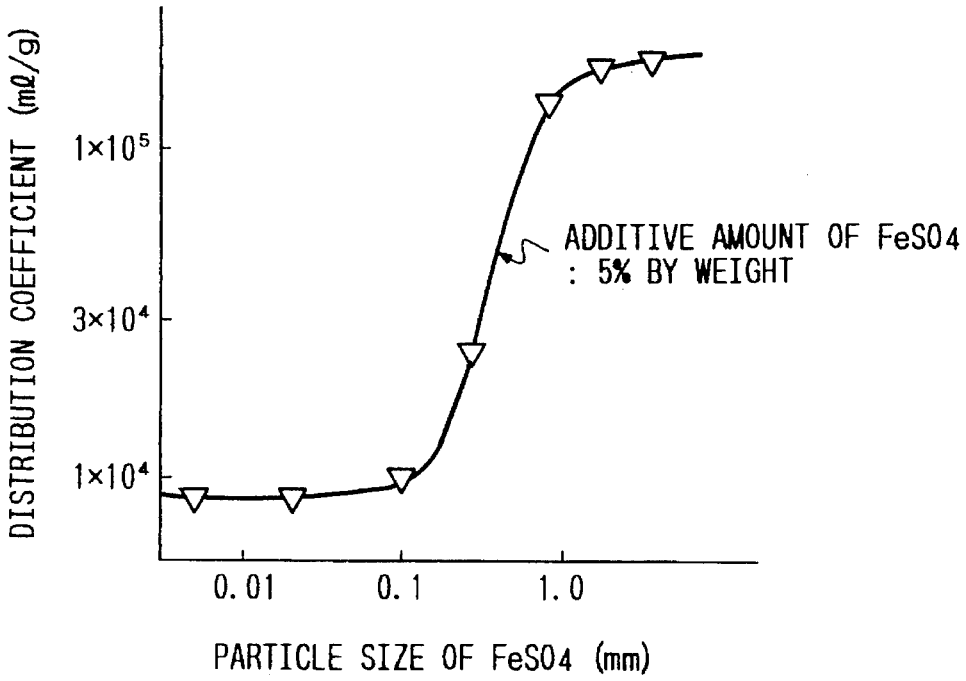
FIG. 2 is a graph indicating an effect of another adsorbent used in another embodiment of the present invention.

Next, an effect of an adsorbent in a case when pellets which are made from incineration ashes are solidified with cement-glass is explained. The cement-glass was an inorganic solidification agent containing sodium silicate, sodium fluorosilicate, and cement as main components, and the pH of the kneaded cement-glass plate paste was about 8. A distribution coefficient of a solidified body in a case when 5% ferrous sulfate by weight was added to the cement-glass as an adsorbent is indicated in FIG. 2. In this case, a remarkable effect was observed also in a region where particle sizes of the adsorbent was larger than 0.1 mm. However, when using ferrous sulfate which was previously processed with a water-repellent treatment as above described, such a large distribution coefficient as $3\times10^5$ ml/g was obtained even with the adsorbent having particle sizes less than 0.1 mm.

As above described, retainability of the solidified body for C-14 can be remarkably improved by addition of a granular adsorbent, concretely a granular adsorbent, having particles sizes at least 0.1 mm, preferably at least 1 mm, to a cementitious solidification agent. Furthermore, even if the particle sizes are small, the retainability of the solidified body for C-14 can be remarkably improved by using the adsorbent which is previously processed with a water-repellent treatment.

In the above results of the experiments, effects of the cases when calcium nitrate and ferrous sulfate were used as the adsorbents were explained. However, any compound which is soluble and yields precipitation by a reaction with carbonic ions can be used as the adsorbent; concretely, compounds such as alkaline earth metal compounds ($CaCl_2$, $Ca(NO_3)_2$, $SrCl_2$, $MgSO_4$, $BaCl_2$, etc.) and transition metal compounds ($FeCl_2$, $Fel_2$, $CoCl_2$, $Mn(NO_3)_2$, etc.) can be used.

Figure 3:
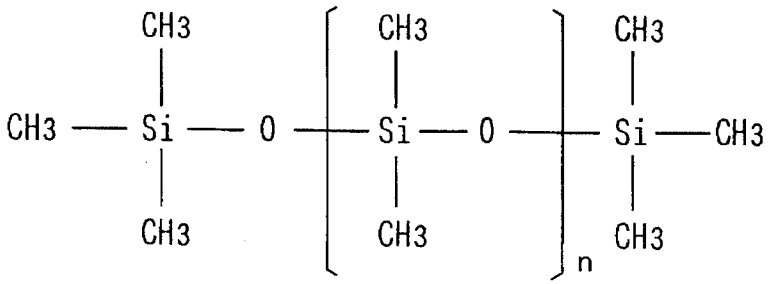
FIG. 3 is a structural formula for explaining a molecular structure of an adsorbent used in an embodiment of the present invention.

As for another substance, organic silane was found to be effective. As the molecular structure of the organic silane used in the experiment which is indicated in FIG. 3 reveals, the organic silane is naturally water-repellent. Accordingly, using a solidification agent containing 98% slag cement by weight and 2% organic silane by weight, the above described incineration ashes were solidified. Subsequently, a distribution coefficient for C-14 was measured. The distribution coefficient was $8\times10^4$ ml/g when using 100% slag cement by weight, but it was improved to $3\times10^5$ ml/g by addition of the organic silane. Although an adsorption mechanism for C-14 of the organic silane is not clearly investigated yet, it is assumed that the organic silane precipitates carbonic ions in the same manner as calcium nitrate and ferrous sulfate do. Furthermore, the above described adsorbents are not necessarily used respectively, but a plurality of adsorbents can be used in a mixing condition.

In conclusion of the present embodiment, a compound which is soluble and yields precipitation by a reaction with carbonic ions is effective for an adsorbent for C-14 which is previously mixed with a solidification agent, and the compound is preferably added to the solidification agent in a granular state (particle size is at least 1 mm) or in a condition wherein the adsorbent has been processed by a water repellent treatment.

EMBODIMENT 2

Figure 4:
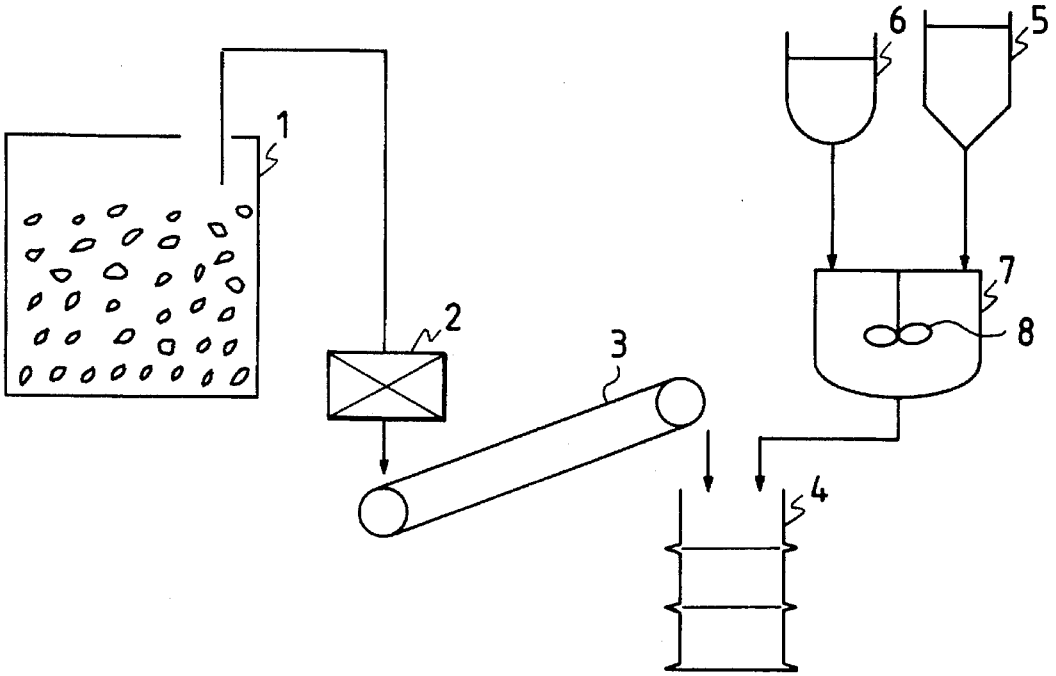
FIG. 4 is a schematic drawing for explaining a processing system for solidification of waste pellets used in another embodiment of the present invention.

The present embodiment relates to a solidification treatment of concentrated liquid waste, which is dried and fabricated in pellets, generated from a boiling water reactor nuclear power plant (BWR plant). A process flow of a processing system relating to the present embodiment is schematically indicated in FIG. 4.

The concentrated liquid waste containing sodium sulfate as a main component which is generated from a BWR plant is dried to powder by a dryer, and pelletized in almond shaped pellets having a length of about 3 cm by a pelletizer, and the pellets are stored in the pellet storing tank 1. The pellets are taken out from the tank 1 by the pellet unloader 2, and transferred by the belt-conveyer 3 and filled into the solidification vessel 4. In a manner above described, 220 kg of pellets are loaded in the solidification vessel 4. On the other hand, 150 kg of cementitious solidification agent and 45 kg of water are supplied to the kneader 7 respectively from the solidification agent hopper 5 and the kneading water tank 6, and paste of the solidification agent is prepared by the agitator 8. The paste of the solidification agent is poured into the solidification vessel 4 which is filled with the pellets, and a solidified body of the pelletized waste is obtained by curing of the solidification agent.

In the present embodiment, eight kinds of compounds indicated in Table 1 were used as cementitious solidification agents. And, as for cement glass, a solidification agent containing sodium silicate, sodium fluorosilicate, and cement as main components as in embodiment 1 was used.

TABLE 1

| Specification of solidification agent | Distrib. coeff of solid. body |
|---|---|
| (1) Slag cement (Type C) (Comparative exampl. 1) | $1.0 \times 10^2$ml/g |
| (2) 100% Cement glass (Comparative example 2) | $7.5 \times 10^1$ml/g |
| (3) 95% Cement glass + 5% $CaCl_2$ p. size 1 mm | $2.0 \times 10^2$ml/g |
| (4) 95% Cement glass + 5% $SrCl_2$ p. size 1 mm | $2.5 \times 10^2$ml/g |
| (5) 95% Cement glass + 5% $Ba(NO_3)_2$ p. size 1 mm | $1.3 \times 10^2$ml/g |
| (6) 95% Cement glass + 5% $FeSO_2$ p. size 1 mm | $1.2 \times 10^3$ml/g |
| (7) 95% Cement glass + 5% $CoCl_2$ p. size 1 mm with water-repellent treatment | $8.5 \times 10^2$ml/g |
| (8) 95% Cement glass + 5% $FeCO_3$ p. size 0.05 mm | $4.3 \times 10^2$ml/g |

Remarks: All of % in the table are by weight.

Samples of the obtained eight kinds of solidified bodies were taken by core-boring after curing of the solidified bodies for three months, and distribution coefficients for C-14 were measured. Results of the measurement are also indicated in Table 1.

First, cases using salts of alkaline earth metals as adsorbents (cases (3), (4), (5) in Table 1) increased the distribution coefficients larger than that of the comparative examples, but the increment was as large as three times at the maximum and not so much. The reasons why the increment was not so much were examined and understood as explained hereinafter.

First, carbonic ions are assumed to be precipitated by the following reaction.

$$MCl_2+CO_3^{2-}\rightarrow MCO_3\downarrow 2Cl^- \quad (3)$$

where, M indicates an alkaline earth metal. sulfate is contained in the waste as in the present embodiment, a reaction expressed by the following equation (4) occurs and a part of the added alkaline earth metal is consumed by a reaction with sulfate ions.

$$MCl_2+SO_4^{2-}\rightarrow MSO_4\downarrow 2Cl^- \quad (4)$$

As a result, it is thought that the reaction expressed by the equation (3) does not proceed thoroughly, and accordingly, the increment of the distribution coefficient becomes not so much.

On the other hand, the cases using salts of transition metals as adsorbents (cases (6) and (7) in Table 1) increased the distribution coefficients more than one order larger than that of the comparative examples, and high adsorbing performance were obtained. The reason is thought to be that the reaction expressed by the equation (4) to consume the transition metals does not proceed with the salts of the transition metals.

The case (8) in Table 1 indicated a result of an experiment when ferrous carbonate (an insoluble carbonate compound) having an average particle size of 0.05 mm was added, and it revealed that addition of insoluble carbonic compound as an adsorbent was also effective. The reason is thought to be that carbonic ions were fixed by the isotopic exchange. In this case, as a rate of the isotopic exchange depends on crystallinity and specific surface area of the carbonate compounds, it is necessary to choose the above properties of the carbonate compounds adequately in a step of designing according to its objectives. Furthermore, as for carbonate compounds, insoluble carbonate salts of alkaline earth metal are also an effective addition to the carbonate salts of the transition metals.

Additionally, although it is not indicated in the Table 1, a distribution coefficient of a body which was solidified sodium sulfate pellets with cement glass containing 4% organic silane compounds was measured, and a value of $5.3\times10^2$ ml/g was obtained. It was almost the same effect as the case when $FeCO_3$ was added.

In conclusion of the present embodiment, compounds which are soluble and yield precipitation by a reaction with carbonic ions and insoluble carbonate compounds are effective for adsorbents for C-14 which are previously mixed with a solidification agent. However, when the above compound is consumed with a reaction with special compounds which are contained in the waste, there may be an occasion when performance of the above compound as an adsorbent decreases remarkably, and a precaution is necessary. Concretely, soluble transition metal compounds, carbonate salts of transition metal and alkaline earth metal, and organic silane compounds are especially effective to a waste including sodium sulfate.

In accordance with findings by the embodiments 1 and 2, hydroxides of alkaline earth metals and transition metals, for example $Ca(OH)_2$, $Ba(OH)_2$, $Fe(OH)_2$, $Fe(OH)_3$, seemed to be effective, but addition of the above hydroxides to a solidification agent as an adsorbent was found to be actually ineffective in increasing the distribution coefficient for C-14. The reason for the ineffectiveness is explained hereinafter. The first reason is that solubility of the hydroxides of the above alkaline earth metals and transition metals are two orders smaller than that of $CaCl_2$ etc., and consequently, precipitation reactions expressed by the equations (3) and (4) scarcely occur. The second reason is thought that $Ca(OH)_2$ is already included in the solidification agent itself if the cementitious solidification agent is used, and further addition of adsorbent of hydroxides group does not reveal special effects. The above described phenomenon is not special for the present embodiment, but is applicable to other embodiments.

For a reference, solubilities in water of representative adsorbents relating to the present invention are shown in Table 2 in comparison with hydroxides.

TABLE 2

| Adsorbents | Present invention | | | | |
|---|---|---|---|---|---|
| Solubility (% by weight) | $CaCl_2$ 42.7 | $Ca(NO_3)_2$ 56.4 | $SrCl_2$ 32.3 | $MgSO_4$ 25.2 | $FeCl_2$ 38.4 |
| Adsorbents | Present invention | | | Comparatives | |
| Solubility (% by weight) | $FeSO_4$ 17.2 | $CoCl_2$ 32.3 | $Mn(NO_3)_2$ 56.8 | $Ca(OH)_2$ 0.16 | $Sr(OH)_2$ 0.80 |

EMBODIMENT 3

In the previous embodiments 1 and 2, the adsorbents for C-14 were added into the solidification agents, but, a part of waste pellets can be substituted with the adsorbents. That is, conventional cement glass is used as a solidification agent, and an adsorbent made from pelletized calcium chloride is concurrently filled into a solidification vessel when pelletized waste is filled into the vessel. A large distribution coefficient can be obtained by the method described above, because, when carbonic ions containing C-14 dissolve into water, the adsorbent such as calcium chloride also dissolves simultaneously into the water and precipitates the carbonic ions by a chemical reaction.

In the present embodiment, 20 parts by weight of waste pellets which were same pellets as used in the embodiment 2 and one part by weight of pelletized calcium chloride having almost the same shape as the waste pellet were mixed homogeneously, filled into a solidification vessel, and solidified with cement glass. A distribution coefficient of the obtained solidified body in the present embodiment wherein the adsorbent pellets were used was $2.5\times10^2$ ml/g and improved by one order in comparison with a distribution coefficient of the solidified body without any adsorbent, $7.5\times10^1$ ml/g.

In the present embodiment, calcium chloride is used, but other adsorbents previously described are naturally usable. Furthermore, the above described method is naturally applicable to solidification of metallic waste, i.e., a so-called a heterogeneous solidified body.

EMBODIMENT 4

The present embodiment is a solidification process for spent ion exchange resin (hereinafter called spent resin) generated from pressurized water reactor nuclear power plants (PWR plant).

Figure 5:
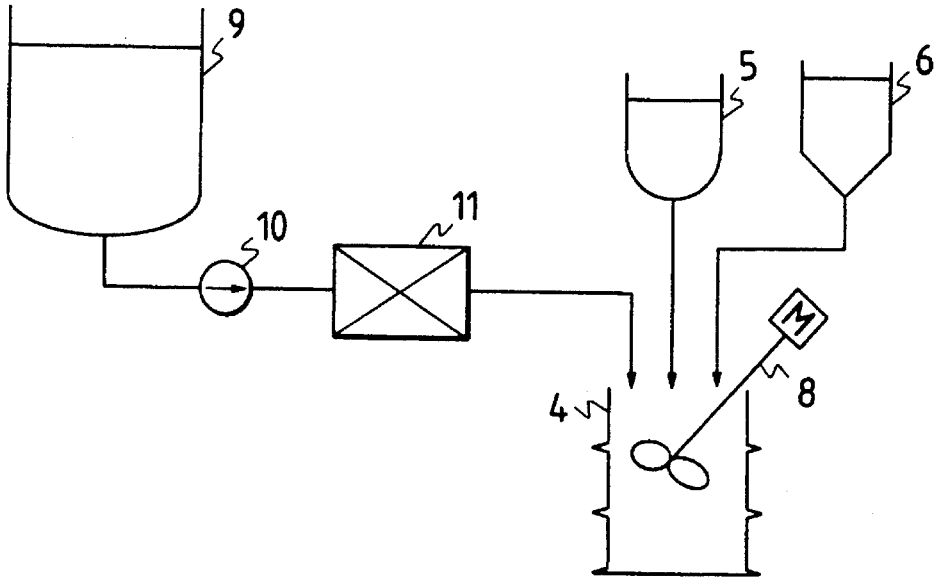
FIG. 5 is a schematic drawing for explaining a processing system for homogeneous solidification of spent resin used in another embodiment of the present invention.

A process flow of the present embodiment is indicated schematically in FIG. 5.

First, 120 kg of cementitious solidification agent in the solidification agent hopper 5 and 50 kg of water in the kneading water tank 6 are transferred to the solidification vessel 4. The solidification vessel 4 is previously furnished with the agitator 8, and paste of the solidification agent is prepared in the vessel 4. On the other hand, spent resin in slurry state which has been stored in the spent resin tank 9 is transferred to the dehydrator 11 by the transfer pump 10, and is dehydrated by centrifugal dehydration to obtain spent resin the water content of which is about 50%. Next, 120 kg of the spent resin is transferred to the solidification vessel 4 wherein the paste of the solidification agent is stored, and the spent resin and the paste of the solidification agent are mixed well by operation of the agitator 8. After completion of the mixing, the agitator 8 is detached from the solidification vessel 4, and a solidified body preparing operation is finished. A lid is placed on the solidification vessel. After curing for a month at room temperature, a distribution coefficient of the solidified body for C-14 was measured.

Specification on each of five kinds of solidification agents used in the present embodiment is indicated in Table 3 with values of obtained distribution coefficient.

TABLE 3

| Specification of solidification agent | Distrib. coeff of solid. body |
|---|---|
| (1) Slag cement (type C) 97% + Carbon fiber 3% (Comparative example) | $5.5\times10^3$ml/g |
| (2) Slag cement(type C) 92% + Carbon fiber 3% + $SrCl_2$ 5% of 1 mm in diameter | $6.3\times10^3$ml/g |
| (3) Slag cement(type C) 92% + Carbon fiber 3% + $SrCl_2$ 5% with water repellent treatment | $8.3\times10^4$ml/g |
| (4) Slag cement(type C) 92% + Carbon fiber 3% + organic silane 5% | $3.7\times10^4$ml/g |
| (5) Slag cement(type C) 87% + Carbon fiber 3% + $CaCO_3$ 10% | $1.4\times10^4$ml/g |

Remarks: all of % are by weight.

In a case (3) of Table 3, silicone oil which is dissolved in an organic solvent is sprayed onto strontium chloride granules having an average diameter of 0.1 mm in order to perform a water repellent treatment, and subsequently, the granules were dried for eliminating the solvent. Main component of the organic silane shown in (4) of Table 3 was vinyltriethoxysilane ($CH_2.CHSi(OC_2H_4OCH_3)_3$), and in this case, the solidification agent was prepared by spraying the organic silane which was dissolved in an organic solvent directly onto cement. Besides, carbon fiber was added in order to improve mechanical strength of the solidified body.

From the results relating to distribution coefficients shown in Table 3, it is revealed that the $SrCl_2$ of 1 mm in diameter scarcely has an effect as an adsorbent in the present embodiment. The reason is assumed to be that the necessary time for kneading the spent resin and the cement takes about one hour because homogeneous kneading of the spent resin and the cement is relatively difficult, and the $CrCl_2$ has been dissolved during the mixing (the kneading time in the embodiments 1 and 2 are short as about 5 minutes). On the contrary, all adsorbents from (3) to (5) obtain remarkable effects, and it is revealed that the present invention is effective not only for pelletized waste but also for so-called homogeneous solidified bodies.

Figure 6:
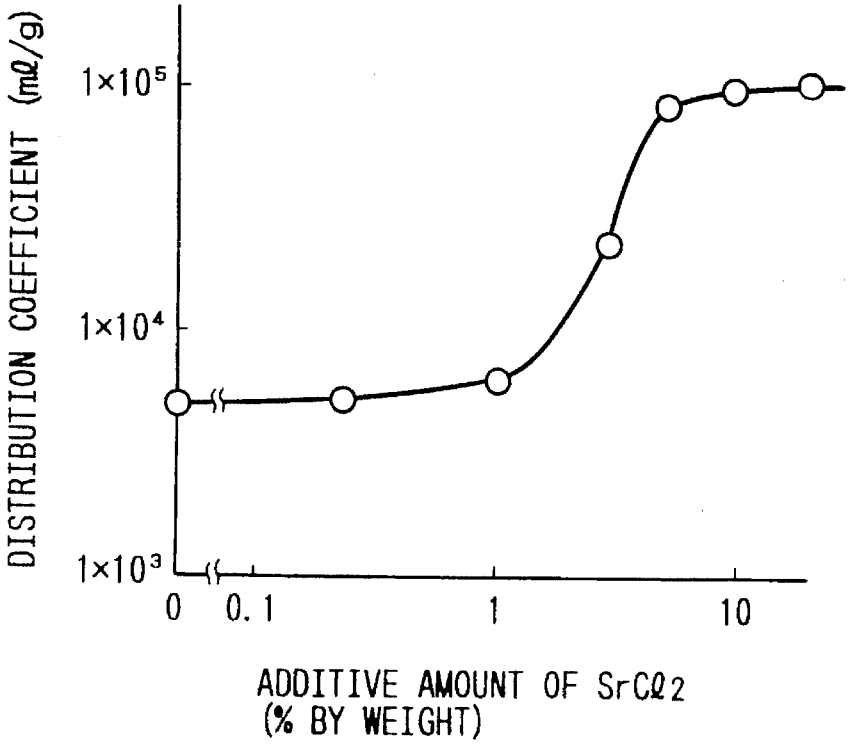
FIG. 6 is a graph indicating an effect of an adsorbent made from strontium chloride which is used in another embodiment of the present invention.

Furthermore, a relationship between additive amounts of the adsorbent and distribution coefficients was measured on small scale (100 ml) solidified bodies of spent resin using $SrCl_2$ which has been processed with the water repellent treatment. The results are shown in FIG. 6. The effect of the adsorbent is revealed from the additive amount of about 1% by weight, and a saturation trend is observed in a range exceeding 10–20% by weight. Quantitative values of the saturation differ depending on the kind of solidification agents and the adsorbents, but the above described saturation trend appears even in the embodiments 1 and 2 as well.

A comparative example (1) shown in Table 3 reveals that a relatively large distribution coefficient can be obtained by using cementitious solidification agents even without any adsorbents. The reason is that the cement contains a large amount of calcium, and the calcium reacts with carbonic ions containing C-14 to yield precipitation. However, solubility of calcium in the cement is as small as about one gram per one liter of water. On the contrary, solubility of $SrCl_2$ is two orders larger than that of calcium, and consequently, $SrCl_2$ is assumed to have a high performance as an adsorbent. Accordingly, soluble adsorbents which are used in the present invention as indicated in the above embodiments from 1 to 3 preferably have solubility of more than 1 gram per one liter of water.

EMBODIMENT 5

The present embodiment relates to a plastics solidified body having preferable retainability for C-14.

A process for obtaining a solid body by the steps of drying liquid radioactive waste, pulverizing, kneading with plastics such as unsaturated polyester, and curing is widely adopted.

In the present embodiment, a 10% solution of a simulated concentrated liquid waste containing 0.1% sodium carbonate by weight including C-14, 9% sodium sulfate by weight, and 0.9% ferrous oxide by weight was used. First, after the concentrated liquid waste was dried into powder having average particle size of about 50 micrometers by a centrifugal thin film dryer, 5 parts by weight of ferrous sulfate having an average particle diameter of about 100 micrometers were added to 100 parts by weight of the waste powder as an adsorbent and mixed by a powder mixer. Subsequently, 20 kg of the mixed powder and 30 kg of unsaturated polyester to which a polymerization initiator was added were mixed homogeneously by a kneader, and a plastics solidified body was prepared. A distribution coefficient for C-14 of the obtained solidified body was measured. The result on a sample without the adsorbent was $1.4\times10^0$ ml/g, but the value was increased to $7.8\times10^2$ ml/g by addition of the adsorbent.

In the present embodiment, as the adsorbent reacts scarcely with the plastics in preparation of the solidified body, the adsorbent in either of granular type or powder type can be used. And, the adsorbent may be added to the waste powder like as the present embodiment, but the adsorbent may previously be added to the plastics. Next, an embodiment such as the above described case is explained.

In accordance with the present embodiment, a 10% solution of a simulated concentrated liquid waste containing 0.1% sodium carbonate by weight including C-14, 9% sodium sulfate by weight, and 0.9% ferrous oxide by weight was used, and the concentrated liquid waste was dried into powder having an average particle size of about 50 micrometers by a centrifugal thin film dryer. On the other hand, as a solidification agent, an unsaturated polyester including 20% cobalt carbonate by weight was prepared. A plastics solidified body was prepared by the steps of kneading homogeneously a mixture of 20 kg of the waste powder and 30 kg of the solidification agent, adding 100 g of a polymerization initiator, and curing for polymerization hardening reaction of the plastics. A distribution coefficient for C-14 of the obtained solidified body was measured. The distribution coefficient for C-14 of the solidified body without the adsorbent was $1.4\times10^0$ ml/g, but the distribution coefficient was increased to $5.1\times10^2$ ml/g by addition of the adsorbent.

As above described, the adsorbents can be used by adding to the solidification agent or by mixing with the waste powder in the plastics solidification process. And, the adsorbent can be used in either of granular type or powder type because the adsorbent reacts scarcely with the plastics.

In the present embodiment, ferrous sulfate and cobalt carbonate were used as adsorbents. However, substances which are soluble and yield insoluble precipitates by reactions with carbonic ions (such substances as previously described alkaline earth metal compounds, transition metal compounds, and organic silanes etc.), and insoluble carbonates (such substances as previously described alkaline earth metal carbonates and transition metal carbonates etc.) are naturally effective as adsorbents.

EMBODIMENT 6

Figure 7:
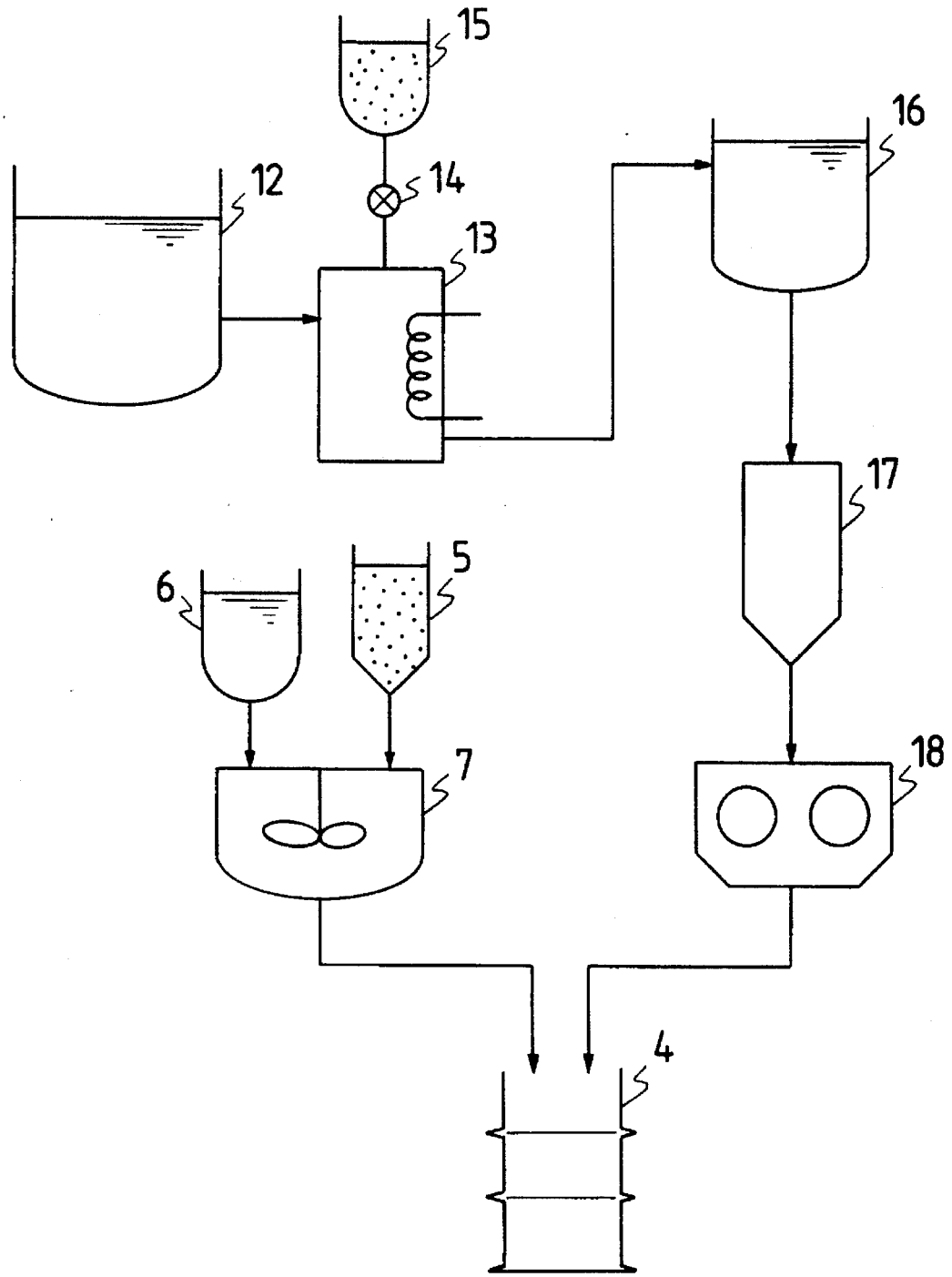
FIG. 7 is a schematic drawing for explaining a processing system for pellet solidification of concentrated liquid waste after pre-treatment used in another embodiment of the present invention.

The present embodiment relates to an improvement on retainability of a solidified body for C-14 by a pre-treatment of wastes. A total flow of a processing system for liquid waste containing sodium sulfate which is generated from BWR plants as a main component is schematically shown in FIG. 7.

Radioactive liquid waste containing sodium sulfate as a main component which is generated by regeneration operations of condensate demineralizers of the BWR plant is temporarily stored in the liquid waste reservoir tank 12. The liquid waste is so adjusted as to have a value of pH in a range from 7 to 9, and subsequently, the liquid waste is transferred to the concentrator 13 in order to be concentrated to about 20% by weight solution. The concentrator used in the prior art only concentrates the liquid waste. On the contrary, the concentrator 13 used in the present embodiment is furnished with piping 14 for adding an adsorbent, and a predetermined amount of ferrous sulfate ($FeSO_4.7H^2O$) powder stored in the adsorbent hopper 15 is added to the liquid waste in the concentrator 13.

Here, the effects of additive amount of the adsorbent on retainability of the solidified body for C-14 were determined by changing the additive amount of ferrous sulfate, the adsorbent, in a range from 0 to 5 parts by weight to 100 parts by weight of solid components in the liquid waste.

The inside of the concentrator 13 is heated to about 90° C., and a reaction expressed by the following equation proceeds effectively by an assistance of the adsorbent which is added and dissolved in the liquid waste.

$$FeSO_4+CO_3^{2-}\rightarrow FeCO_3\downarrow SO_4^{2-} \quad (5)$$

As a result, the liquid waste was concentrated in the concentrator 13, and concurrently, carbonic ions containing C-14 were converted to insoluble ferrous carbonate. The reaction expressed by the above equation may be caused by not only ferrous sulfate but also any soluble salts of transition metals as previously described. Soluble salts of alkaline earth metals are also usable as adsorbents, but in this case, an efficiency of the conversion becomes worse in comparison with the case using the transition metal salts because a part of the adsorbent is consumed by a reaction expressed by the equation (6) of the adsorbent with sodium sulfate which is a component in the liquid waste.

$$Na_2SO_4+CaCl_2 \rightarrow CaSO_4\downarrow 2NaCl \quad (6)$$

The liquid waste wherein carbonic ions containing C-14 are converted to insoluble compounds as above explained is once transferred to the concentrated liquid waste reservoir tank 16, subsequently powdered by the dryer 17, and fabricated to almond shaped pellets by the pelletizer 18. The solidification vessel 4, a drum having a 200 liter capacity, is filled with 220 kg of the pellets. On the other hand, 150 kg of cement glass containing sodium silicate and silicon phosphate as main components from the solidification agent hopper 5 and 45 kg of water from the kneading water tank 6 are respectively supplied to the kneader 7 and a solidification agent paste is prepared by the agitator 8. The paste is poured into the solidification vessel 4 which has been filled with the pellets, and the pellets made from the concentrated liquid waste are converted to a solidified body. After curing of the obtained solidified body for three months, samples were taken from the solidified body by core boring and distribution coefficients for C-14 were measured.

Figure 8:
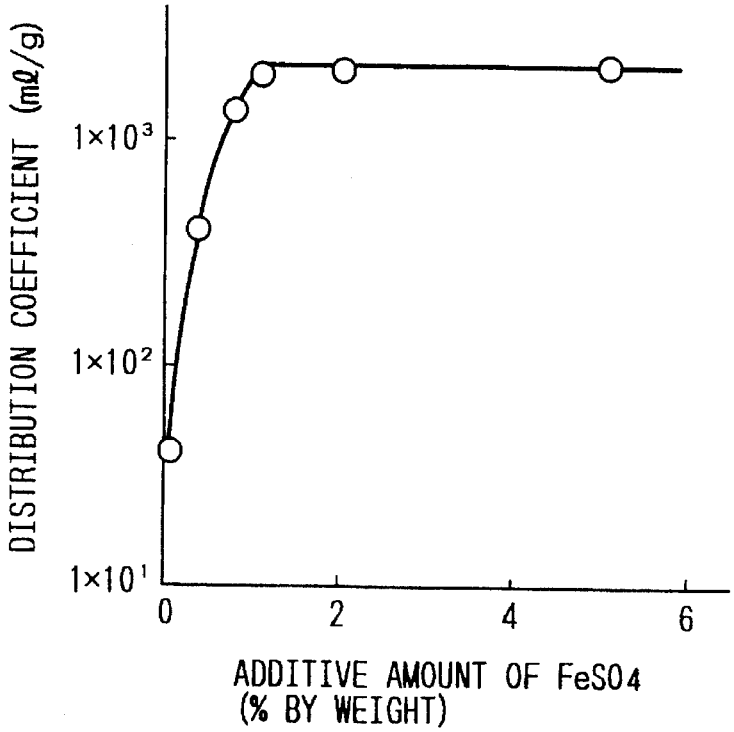
FIG. 8 is a graph indicating an effect of an adsorbent made from ferrous sulfate which is used in another embodiment of the present invention.

The obtained results are shown in FIG. 8. In FIG. 8, the ordinate indicates the distribution coefficients and the abscissa indicates additive amounts of the adsorbent (equivalent to $FeSO_4$) relative to solid components concentration in the liquid waste. Referring to FIG. 8, it is revealed that the distribution coefficient increases with increasing of additive amount of the adsorbent, and the increment of the distribution coefficient indicates a saturating tendency in a range of additive amount larger than 1% by weight. The distribution coefficient at the saturation range is two orders improved in comparison with a value of the distribution coefficient obtained without addition of the adsorbent. The reason that the effect of the adsorbent addition saturates in a range of additive amount larger than 1% by weight is assumed that the amount of the carbonic ions which existed in the liquid waste was very small and addition of 1% of the adsorbent by weight was enough to complete the precipitation reaction expressed by the equation (5).

Furthermore, necessary additive amounts of adsorbents other than the above described $FeSO_4$ for saturation of the distribution coefficient were determined. The results are shown in Table 4.

TABLE 4

| Adsorbent | Optimum additive amount of adsorbent for saturation of the distribution coefficient |
|---|---|
| $FeSO_4$ | 1% by weight |
| $CoCl_2$ | 0.5% by weight |
| $CaCl_2$ | 2.5% by weight |
| $SrSO_4$ | 2.0% by weight |

The reason that the optimum additive amounts of adsorbents such as $CaCl_2$ and $SrSO_4$ are larger than that of $FeSO_4$ and $CoCl_2$ is assumed to be that the adsorbent consuming reaction expressed by the equation (6) concurrently proceeds when alkaline earth metal salts are used. Accordingly, an upper limit of additive amount of the adsorbent is preferably determined as an amount of about two times the additive amount for saturation of the distribution coefficient (for example, in the present embodiment, 2% by weight for $FeSO_4$, and 4% by weight for $SrSO_4$) including some safety margin. Naturally, addition of the adsorbent more than the upper limit of the additive amount does not influence the effect of the adsorbent at all. However, increment of the adsorbent causes increment of waste, and consequently, gives a negative influence to volume reduction efficiency. As for a lower limit of additive amount of the adsorbent, a value equivalent to stoichiometric ratio of the equation (5) must be selected. However, a large amount of non-radioactive carbonic ions in the liquid waste which has been yielded by dissolution of carbon dioxide in air into the liquid waste must be considered in addition to the carbonic ions containing C-14.

For example, when about 200 ppm of carbonic ions exist in a liquid waste which contains 20% solid concentration of sodium sulfate as a main component, the carbonic ion exists equal to 1000 ppm to the solid component in the liquid waste. Accordingly, stoichiometric necessary additive amount of the adsorbent for precipitation of all the carbonic ions by the reaction of the equation (5) equals to about 0.25% by weight to the solid component in the liquid waste, and the above described necessary additive amount gives the lower limit value of the adsorbent to be added.

Conclusively, in order to convert carbonic ions which are contained in liquid or slurry radioactive wastes to insoluble precipitates, an additive amount of the adsorbent which is stoichiometrically enough for making all the carbonic ions insoluble and less than twice the amount for saturating the increment of the distribution coefficient of the solidified body is preferable. Actually, an amount of the carbonic ions is previously measured at the waste reservoir tank 12 etc., and subsequently, an additive amount of the adsorbent may be determined by the above described consideration.

The example explained above is a case wherein the waste is pre-treated by adding the adsorbent at the concentrator 13. However other cases wherein an exclusive apparatus for pre-treatment is installed at a front stage or a rear stage of the concentrator, or the adsorbent is added by utilizing the liquid waste reservoir tank 12 or the concentrated liquid waste reservoir tank 16, are naturally possible. Furthermore, in the present embodiment, an example of solidifying the waste pellets was explained, but the processing system of the present embodiment is applicable to a homogeneous solidification process for direct mixing of the concentrated liquid waste with a cementitious solidification agent and a plastics solidification process for plastic solidification of powder waste. In the above described application, the system after the concentrated liquid waste reservoir tank 16 might be altered depending on methods of solidification.

EMBODIMENT 7

Figure 9:
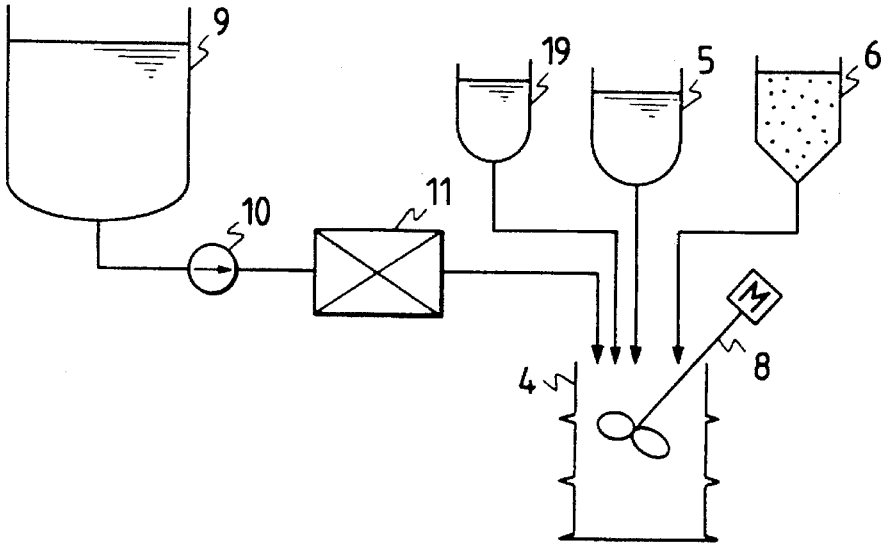
FIG. 9 is a schematic drawing for explaining a processing system for homogeneous solidification of spent resin with cement after pre-treatment used in another embodiment of the present invention.

The present embodiment is a case for solidification treatment of spent resin with cement after a pre-treatment. A system flow for the treatment is schematically indicated in FIG. 9.

First, the spent resin slurry stored in the spent resin tank 9 is transferred to the dehydrator 11 by the transfer pump 10, and the spent resin of about 50% water content is obtained by centrifugal dehydration. After transferring 120 kg of the spent resin to the solidification vessel 4, 50 kg of kneading water is supplied to the solidification vessel 4 from the kneading water tank 6. Subsequently, 2 kg of a liquid adsorbent is supplied to the solidification vessel 4 from the adsorbent tank 19 with mixing homogeneously the kneading water and the spent resin by operation of the agitator 8. The adsorbent used in the present embodiment is an organic silane compound, of which main component is γ-mercaptopropyltrimethoxysilane ($HSC_3H_6Si(OCH_3)_3$), in an emulsion state having a water content of 50%. Continuing the agitation for about one hour after addition of the adsorbent, 120 kg of a solidification agent (slag cement C-type) is additionally supplied to the solidification vessel 4 from the solidification agent hopper 5 and a finally solidified body is prepared. The agitator 8 is detached from the solidification vessel 4. And after curing for one month at room temperature with placing a lid on the solidification vessel, a distribution coefficient for C-14 of the solidified body was measured. As the result, the distribution coefficient was as high as $5.5\times10^4$ ml/g, and nearly coincides with the result obtained in the case wherein the adsorbent was added in the solidification agent as shown in the embodiment 4.

In the present embodiment, the organic silane was used as an adsorbent, but soluble alkaline earth metal salts and transition metal salts were not effective. The reason was revealed that keeping the soluble alkaline earth metal salts and transition metal salts mixed with ion exchange resin for a long time causes ion adsorption of alkaline earth metal ion and transition metal ion, both of which are effective components of the adsorbents.

In accordance with the present invention, C-14 which is included in radioactive waste can be converted to an insoluble substance, and consequently, retainability for C-14 of solidified body of the waste is improved one order and safety of the solidified body is enhanced.

What is claimed is;

1. A composition for solidification treatment of radioactive wastes comprising a solidification agent and at least one compound which yields a water insoluble precipitate by a reaction with a carbonic ion, selected from the group consisting of water soluble alkaline earth metal compounds, water soluble transition metal compounds and organic silane compounds, said at least one compound being present in a granular state or a water-repelling treated state.

2. A composition for solidification treatment of radioactive wastes as claimed in claim 1, wherein said solidification agent is a hydraulic inorganic solidification agent.

3. A composition for solidification treatment of radioactive wastes as claimed in claim 1, wherein said solidification agent is a plastic solidification agent.

4. A composition for solidification treatment of radioactive wastes as claimed in claim 1, wherein said at least one compound is in a granular state having an average diameter of at least 0.1 millimeter.

5. A composition for solidification treatment of radioactive wastes as claimed in claim 4, wherein said at least one compound is in a granular state having an average diameter of at least 1 millimeter.

6. A composition for solidification treatment of radioactive wastes as claimed in claim 1, wherein said at least one compound has been processed with a water repellent treatment.

7. A composition for solidification treatment of radioactive wastes as claimed in claim 1, wherein, said at least one compound has a solubility in water of at least 1 gram per 1 liter of water.

8. A composition for solidification treatment of radioactive wastes as claimed in claim 1, wherein, said at least one compound has a larger solubility in water than a solubility of hydroxides of alkaline earth metals and transition metals in water.

9. A method for solidification treatment of radioactive wastes comprising solidifying the radioactive wastes using a composition as claimed in any one of claims 1–6.

10. A method of solidification treatment of radioactive wastes comprising mixing in a vessel to form a mixture radioactive wastes and at least one compound yielding a water insoluble precipitate by a reaction with a carbonic ion, selected from the group consisting of water soluble alkaline earth metal compounds, water soluble transition metal compounds and organic silane compounds in a granular state or a water-repelling treated state; and solidifying the mixture with a solidification agent.

11. A method of solidification treatment for radioactive wastes as claimed in claim 10, wherein said radioactive wastes are solid wastes selected from the group consisting of pellets and metallic waste.

12. A method of solidification treatment for radioactive wastes as claimed in claim 11, wherein said at least one compound is in a pellets state.

13. A method of solidification treatment for radioactive wastes powder comprising mixing in a vessel to form a mixture radioactive waste powder and at least one compound yielding a water insoluble precipitate by a reaction with carbonic ion, selected from the group consisting of water soluble alkaline earth metal compounds, water soluble transition metal compounds and organic silane compounds in a granular state or a water-repelling treated state; and solidifying the mixture with a plastic solidification agent.

14. A method of solidification treatment for radioactive wastes comprising mixing to form a mixture radioactive waste in a liquid condition or a slurry condition with at least one compound yielding insoluble precipitate by a reaction with carbonic ions, selected from the group consisting of water soluble alkaline earth metal compounds, water soluble transition metal compounds and organic silane compounds; and solidifying the mixture with a solidification agent.

15. A method of solidification treatment for radioactive wastes as claimed in claim 14, wherein said at least one compound has a solubility in water of at least 1 gram per 1 liter of water.

16. A method of solidification treatment for radioactive wastes as claimed in claim 14, wherein said at least one compound has a larger solubility in water than a solubility of hydroxides of alkaline earth metals and transition metals in water.

17. A method of solidification treatment for radioactive wastes as claimed in any of claims 14, 15 and 16, comprising mixing said at least one compound with said radioactive waste in an amount at least stoichiometrically satisfactory for precipitating all of the carbonic ions, and at most twice the minimum amount by which a distribution coefficient of the finally obtained solidified body for C-14 indicates a saturated tendency.

18. A method of solidification treatment for radioactive wastes as claimed in claim 17, comprising mixing said at least one compound with said radioactive waste in an amount at most the minimum amount by which a distribution coefficient of a finally obtained solidified body for C-14 indicates a saturated tendency.

19. A method of solidification treatment for radioactive wastes as claimed in claim 14, comprising mixing said radioactive wastes in a liquid condition or a slurry conducting with said at least one compound in a concentrator.

20. A method of solidification treatment for radioactive wastes as claimed in claim 14, comprising mixing said radioactive wastes in a liquid condition or a slurry condition with said at least one compound in a solidification vessel.

21. A method of solidification treatment for radioactive wastes as claimed in claim 14, wherein said radioactive waste contains sodium sulfate, and said at least one compound is a soluble transition metal compound.

22. A method of solidification treatment for radioactive wastes comprising reacting radioactive waste in a liquid condition or a slurry condition with an organic silane compound for yielding insoluble precipitates by a reaction with carbonic ions; and, subsequently, solidifying the radioactive waste.

23. A method of treatment for radioactive wastes as claimed in claim 22, wherein said radioactive waste is spent ion exchange resin in a slurry condition and said method comprises dehydrating said spent ion exchange resin in a slurry condition and, subsequently, reacting the dehydrated spent ion exchange resin with said organic silane compound.

* * * * *